US012612135B2

(12) United States Patent
Yoo et al.

(10) Patent No.: US 12,612,135 B2
(45) Date of Patent: Apr. 28, 2026

(54) FLOATING OFFSHORE STRUCTURE HAVING ONE-SIDE SPREAD MOORING SYSTEM APPLIED THERETO

(71) Applicant: SAMSUNG HEAVY INDUSTRIES CO., LTD., Gyeonggi-do (KR)

(72) Inventors: Dong Hoon Yoo, Gyeongsangnam-do (KR); Dae Hoon Kang, Gyeongsangnam-do (KR)

(73) Assignee: SAMSUNG HEAVY INDUSTRIES CO., LTD., Gyeonggi-do (KR)

( * ) Notice: Subject to any disclaimer, the term of this patent is extended or adjusted under 35 U.S.C. 154(b) by 407 days.

(21) Appl. No.: 18/552,159

(22) PCT Filed: Apr. 6, 2022

(86) PCT No.: PCT/KR2022/004935
§ 371 (c)(1),
(2) Date: Sep. 22, 2023

(87) PCT Pub. No.: WO2022/216032
PCT Pub. Date: Oct. 13, 2022

(65) Prior Publication Data

US 2024/0182138 A1 Jun. 6, 2024

(30) Foreign Application Priority Data

Apr. 8, 2021 (KR) ..... 10-2021-0045974

(51) Int. Cl.
*B63B 21/50* (2006.01)
*B63B 35/44* (2006.01)

(52) U.S. Cl.
CPC ..... *B63B 21/50* (2013.01); *B63B 35/44* (2013.01)

(58) Field of Classification Search
CPC ..... B63B 21/50; B63B 2021/505
See application file for complete search history.

(56) References Cited

U.S. PATENT DOCUMENTS 3,613,625 A * 10/1971 Rudelius ..... B63B 21/00 254/266
3,886,882 A * 6/1975 Thornburg ..... B63B 21/50 114/40

(Continued)

FOREIGN PATENT DOCUMENTS

CA 2718871 A1 * 4/2012 ..... B63B 21/04
EP 1060981 A1 * 12/2000 ..... B63B 21/50

(Continued)

OTHER PUBLICATIONS

World Intellectual Property Organization, International Search Report for Application No. PCT/KR2022/004935, mail date Jul. 6, 2022, 5 total pages.

*Primary Examiner* — Magdalena Topolski
(74) *Attorney, Agent, or Firm* — SoCal IP Law Group LLP; Mark Andrew Goldstein

(57) ABSTRACT

A floating offshore structure to which a one-side spread mooring system is applied is provided. The floating offshore structure includes: first mooring lines fastened to one of a port and a starboard of a hull, the first mooring lines being spread out in a first direction, which is a direction away from the hull, into a seabed; and second mooring lines fastened to the same side of the hull as the first mooring lines, the second mooring lines being spread out in a second direction, which is a direction toward an opposite side of a centerline of the hull to the first mooring lines, into the seabed through a lower space of the hull.

16 Claims, 9 Drawing Sheets

(56) References Cited

U.S. PATENT DOCUMENTS

| | | | | |
|---|---|---|---|---|
| 6,655,312 | B1 * | 12/2003 | Pollack | B63B 21/50 114/293 |
| 9,121,230 | B2 * | 9/2015 | Saint-Marcoux | E21B 17/015 |
| 9,616,975 | B2 * | 4/2017 | Meling | B63B 22/02 |
| 9,764,802 | B2 | 9/2017 | Lee | |
| 11,198,490 | B2 * | 12/2021 | Liu | B63B 21/50 |
| 11,377,174 | B2 * | 7/2022 | Bech | B63B 21/50 |
| 11,541,973 | B1 * | 1/2023 | Hellesmark | B63B 21/50 |
| 2007/0022934 | A1 * | 2/2007 | Lee | B63C 11/02 114/293 |
| 2007/0240624 | A1 | 10/2007 | Collee et al. | |
| 2019/0161146 | A1 * | 5/2019 | Hellesmark | B63B 27/34 |

FOREIGN PATENT DOCUMENTS

| | | | | | |
|---|---|---|---|---|---|
| GB | 2336143 | A | * | 10/1999 | B63B 21/50 |
| JP | 2010269611 | A | | 12/2010 | |
| KR | 101507486 | B1 | | 4/2015 | |
| KR | 101599026 | B1 | | 3/2016 | |
| KR | 20170112423 | A | * | 10/2017 | B63B 35/44 |
| KR | 101801803 | B1 | | 11/2017 | |
| KR | 20180046265 | A | | 5/2018 | |
| KR | 20250041435 | A | * | 3/2025 | B63B 21/16 |
| WO | WO-9902394 | A1 | * | 1/1999 | B63B 21/50 |
| WO | WO-2021094460 | A1 | * | 5/2021 | B63B 21/20 |
| WO | 2022216032 | A1 | | 10/2022 | |
| WO | WO-2023182887 | A1 | * | 9/2023 | B63B 35/44 |

* cited by examiner

FLOATING OFFSHORE STRUCTURE HAVING ONE-SIDE SPREAD MOORING SYSTEM APPLIED THERETO

RELATED APPLICATION INFORMATION

This patent claims priority from International PCT Patent Application No. PCT/KR2022/004935 filed Apr. 6, 2022 entitled "FLOATING OFFSHORE STRUCTURE HAVING ONE-SIDE SPREAD MOORING SYSTEM APPLIED THERETO", which claims priority to Korean Patent Application No. 10-2021-0045974, filed Apr. 8, 2021, all of which are incorporated herein by reference in their entirety.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

TECHNICAL FIELD

The present disclosure relates to a mooring system for a floating offshore structure and, more particularly, to a one-side spread mooring system.

BACKGROUND

Floating offshore structures such as Floating Liquefied Natural Gas (FLNG) or Floating Production, Storage, and Offloading (FPSO) vessels can transport cargo (e.g., LNG, etc.) produced and stored to a carrier to be transported to a place of demand.

In the case of FPSO, a stern offloading method, in which cargo is transported to a carrier approaching from behind through hoses, is usually applied. In the case of FLNG, a side-by-side offloading method, in which cargo is transported to a carrier approaching from the side with loading arms, is usually applied.

FIGS. 1 and 2 illustrate mooring methods for floating offshore structures, and FIG. 3 illustrates interference that may occur between an FPSO vessel to which spread mooring applied thereto and a carrier.

Referring to FIG. 1, spread mooring is a multi-point fixed mooring method that is generally applicable to areas of the sea with a benign marine environment. The spread mooring method is applicable only to FPSO projects, not to FLNG. As described above, side-by-side offloading needs to be applied to an FLNG vessel 10 to transport cargo because spread mooring causes interference between an LNG carrier 20 and mooring lines 15 (see P1 and P2 of FIG. 3).

Referring to FIG. 2, turret mooring is a single-point fixed mooring method that is generally applied to areas of the sea with a harsh marine environment because wind and wave resistance can be minimized through rotation. The turret mooring method may be applicable to both FPSO and FLNG projects. However, as turret equipment and thruster equipment are needed, there is a limitation that the turret mooring method is a more expensive solution than the spread mooring method.

SUMMARY

Technical Problems

Exemplary embodiments of the present disclosure provide a floating offshore structure to which a one-side spread mooring system capable of reducing capital expenditures (CAPEX) for operating a floating offshore structure by enabling side-by-side offloading, even when a spread mooring system is applied to a Floating Liquefied Natural Gas (FLNG) vessel, is applied.

Other objects of the present invention will be readily understood from the description that follows.

Technical Solutions

According to an aspect of the present disclosure, a floating offshore structure to which a one-side spread mooring system is applied includes: first mooring lines fastened to one of a port and a starboard of a hull, the first mooring lines being spread out in a first direction, which is a direction away from the hull, into a seabed; and second mooring lines fastened to the same side of the hull as the first mooring lines, the second mooring lines being spread out in a second direction, which is a direction toward an opposite side of a centerline of the hull to the first mooring lines, into the seabed through a lower space of the hull.

The second mooring lines may be spread out in a horizontal direction along a bottom surface of the hull and then spread out at a downward inclination into the seabed.

The floating offshore structure may further include a line holding unit holding middle parts of the second mooring lines, the line holding unit being installed on a bottom surface of the hull to be slidably movable, and points where the second mooring lines begin to be spread out at the downward inclination into the seabed may be determined by a position of the line holding unit.

The floating offshore structure may be a Floating Liquefied Natural Gas (FLNG) vessel.

Side-by-side offloading may be performed by a carrier approaching the floating offshore structure, from a side of the floating offshore structure where the first mooring lines and the second mooring lines are not connected.

Other aspects, features and advantages other than those described above will become apparent from the following drawings, claims and detailed description of the invention.

Advantageous Effects

According to exemplary embodiments of the present disclosure, capital expenditures (CAPEX) for operating a floating offshore structure can be reduced by enabling side-by-side offloading, even when a spread mooring system is applied to a Floating Liquefied Natural Gas (FLNG) vessel.

DESCRIPTION—BEST MODES FOR CARRYING OUT THE INVENTION

Figure 1:
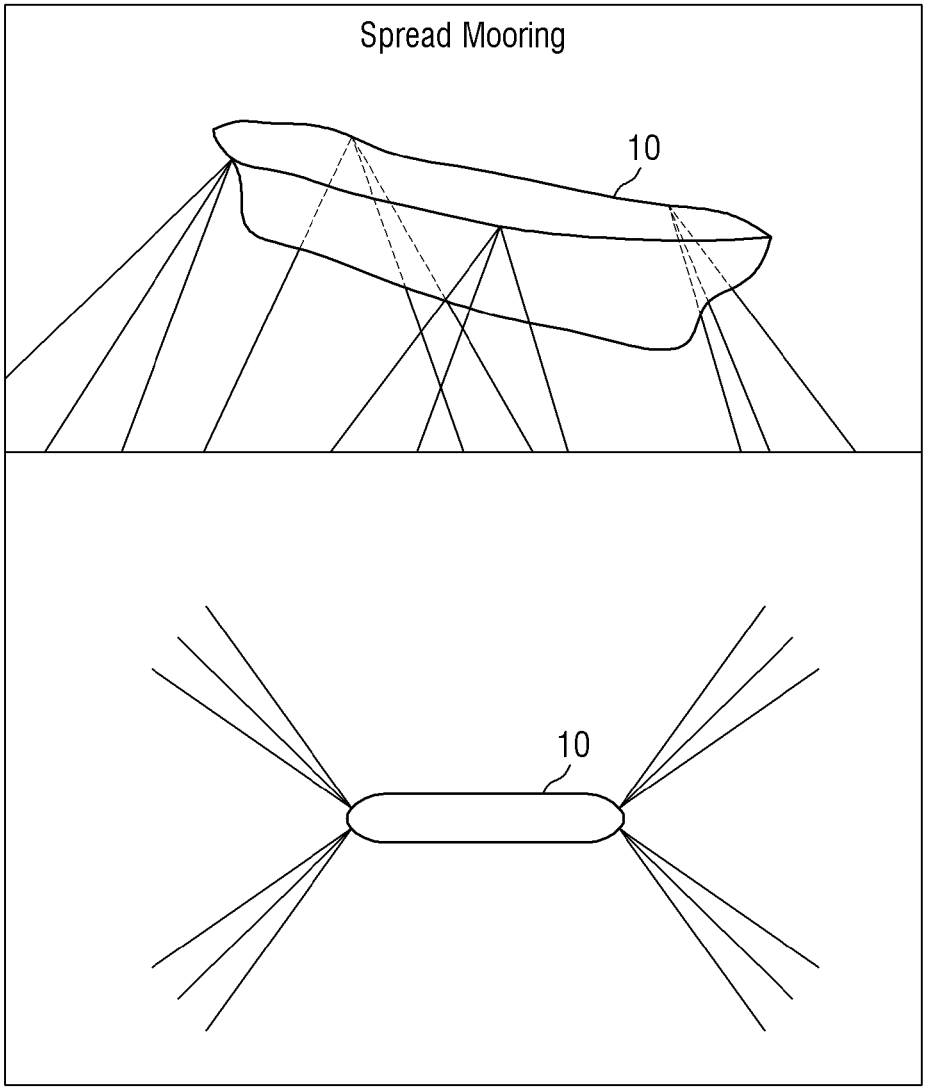
FIGS. 1 and 2 illustrate mooring methods for floating offshore structures.
Figure 2:
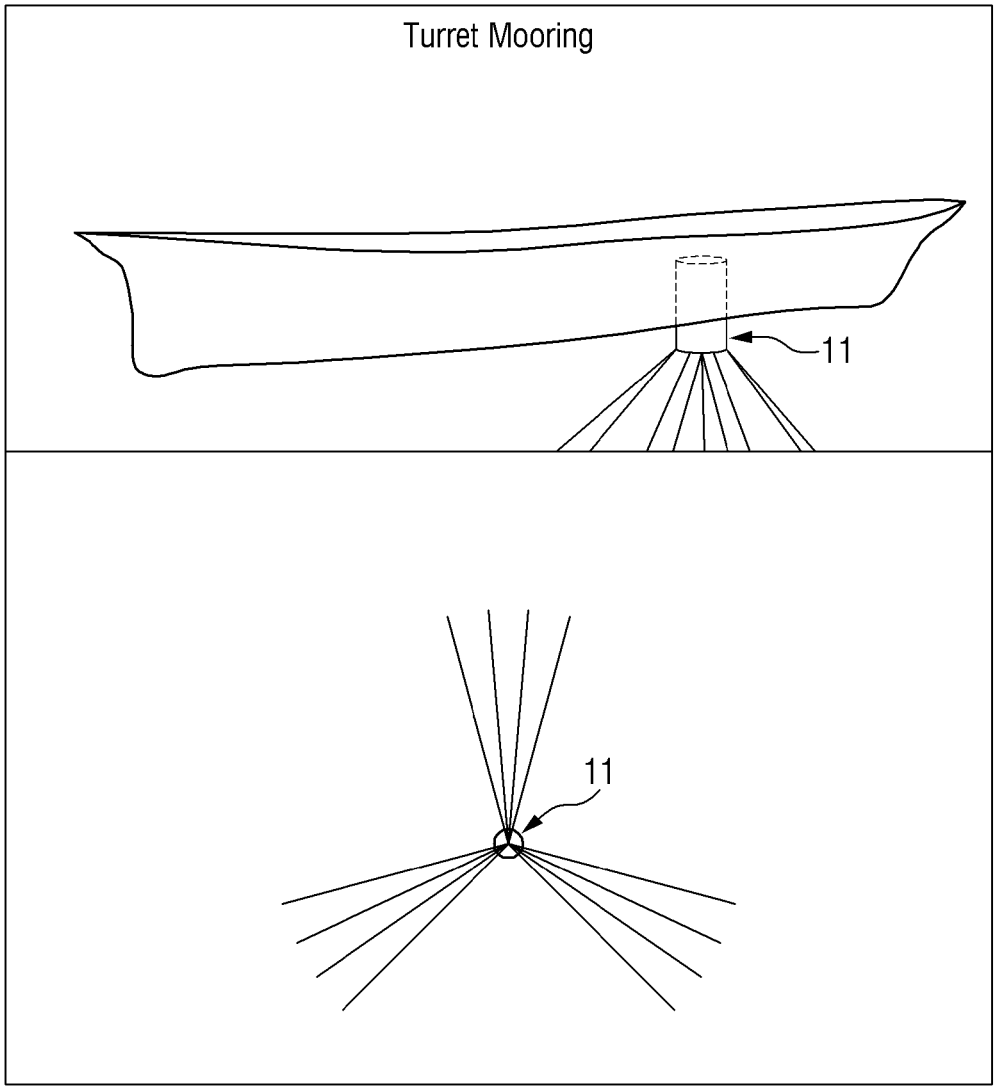

While the present invention to which the asymmetric spread mooring concept may be modified in various ways and take on various alternative forms, specific embodiments thereof are shown in the drawings and described in detail below. However, it should be understood that there is no intent to limit the present invention to the particular forms disclosed, but on the contrary, the present invention covers all modifications, equivalents, and alternatives falling within the spirit and scope of the present invention.

Figure 4:
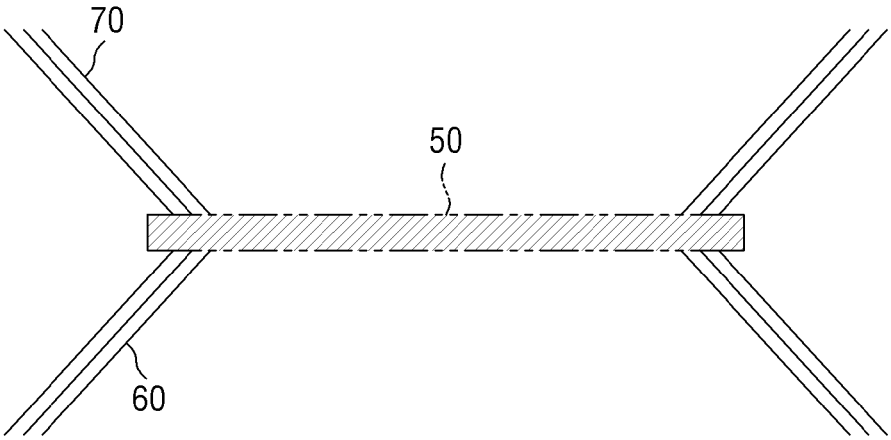
FIGS. 4 and 5 illustrate the concept of a one-side spread mooring system for a floating offshore structure, according to an embodiment of the present invention.
Figure 5:
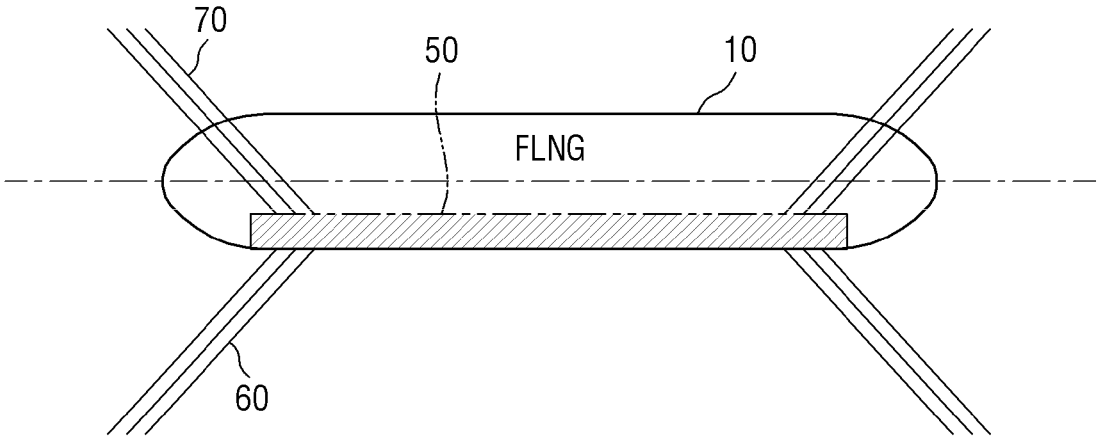

FIGS. 4 and 5 illustrate the concept of a one-side spread mooring system for a floating offshore structure, according to an embodiment of the present invention.

Figure 3:
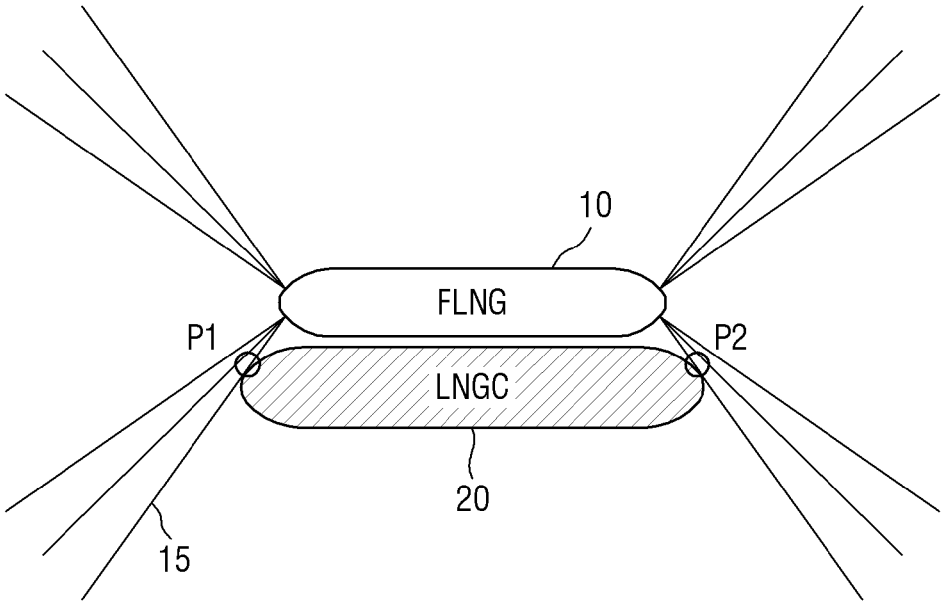
FIG. 3 illustrates interference that may occur between a Floating Production, Storage, and Offloading (FPSO) vessel to which spread mooring is applied and a carrier.

As illustrated in FIG. 3, side-by-side offloading is needed for the transport of cargo from a floating offshore structure such as the FLNG vessel 10 to the carrier 20. However, spread mooring may cause interference between the LNG carrier 20 and the mooring lines 15, and as a result, side-by-side offloading may not be smoothly performed.

Therefore, a spread mooring system may be applied to a floating offshore structure according to an embodiment of the present disclosure, particularly, a Floating Liquefied Natural Gas (FLNG) vessel, but in a different manner from the prior art.

To this end, an FLNG vessel is assumed as a single long bar 50. In this case, mooring lines (60 and 70) for the spread mooring of the bar 50 may be simplified as illustrated in FIG. 4.

FIG. 5 illustrates the effect of spread mooring when the bar 50 and the mooring lines (60 and 70) are arranged on a first side (i.e., the port or the starboard) of an FLNG vessel 10.

Figure 6:
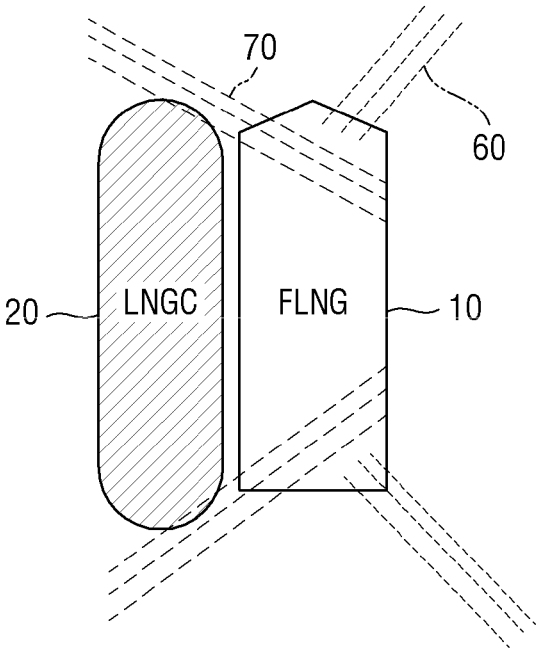
FIGS. 6 and 7 are a plan view and a cross-sectional view, respectively, of a floating offshore structure to which the one-side spread mooring system according to an embodiment of the present invention is applied.
Figure 7:
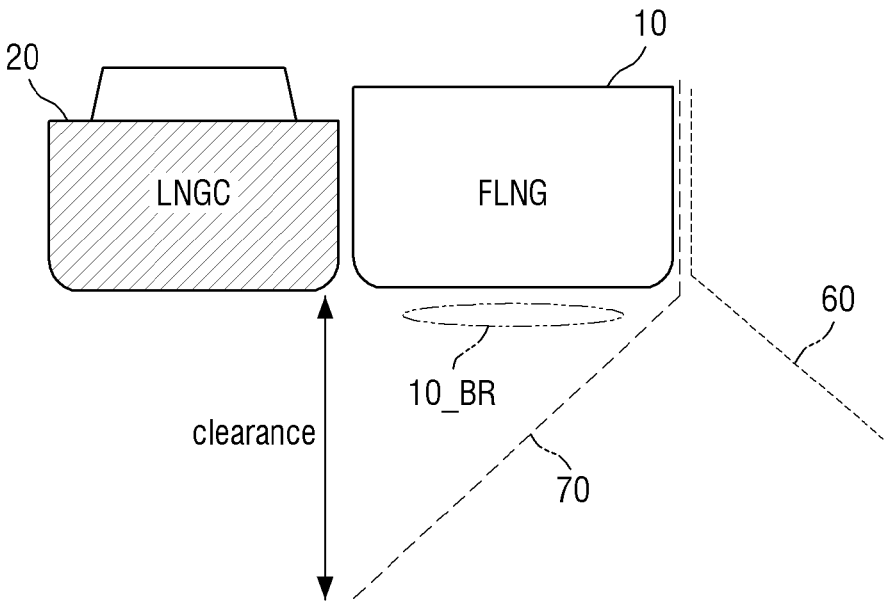

FIGS. 6 and 7 are a plan view and a cross-sectional view, respectively, of a floating offshore structure to which the one-side spread mooring system according to an embodiment of the present invention is applied.

Referring to FIGS. 6 and 7, in the case of a floating offshore structure to which the one-side spread mooring system according to an embodiment of the present invention is applied, mooring lines (60 and 70) may be spread out only on a first side of the floating offshore structure, whereas in the prior art, mooring lines are spread out on both sides (i.e., the port and the starboard) of a center line (i.e., a straight line connecting the bow and the stern) of the hull of the floating offshore structure.

First mooring lines 60 and second mooring lines 70 may be fastened to the first side of the FLNG vessel 10 (i.e., the starboard in the example of FIGS. 6 and 7).

The first mooring lines 60 may be spread out in an outward direction from the first side of the FLNG vessel 10 into the seabed, as in the prior art. For example, the first mooring lines 60 may be spread out in a first direction.

The second mooring lines 70 may be spread out in the outward direction from the first side of the FLNG vessel 10 into the seabed through a lower space 10_BR of the hull, passing through the centerline. The second mooring lines 70 may be spread out in a second direction. The second direction is opposite to the first direction. Here, the term "lower space" means not only the bottom surface of the hull, but also the sea below the hull. In a plan view, the second mooring lines 70 may extend across the bottom surface of the FLNG vessel 10.

Some of the second mooring lines 70 may be spread out along an outer wall of the hull of the FLNG vessel 10. For example, the second mooring lines 70 include portions extending in a vertical direction along the sidewall on the first side (i.e., the sidewall on the starboard side in the example of FIGS. 6 and 7) of the FLNG vessel 10. Here, the vertical direction is a direction toward the seabed.

The LNG carrier 20 for the transport of cargo may perform side-by-side offloading by approaching the FLNG vessel 10, not from the first side where the first mooring lines 60 and the second mooring lines 70 of the FLNG vessel 10 are fastened, but from a second side (i.e., the port side in the example of FIGS. 6 and 7) opposite to the first side.

As the second mooring lines 70 are spread out from below the first side of the FLNG vessel 10 to the seabed, a sufficient clearance can be secured depending on the difference in depth between the LNG carrier 20 and the second mooring lines 70, and as a result, interference can be avoided.

Conventionally, the position, in a horizontal direction, of the floating offshore structure is controlled by spreading out mooring lines on both sides (at a total of four locations) of the floating offshore structure, i.e., on both the port and starboard sides. This is the concept of stably controlling the position of a floating body by evenly applying tension at each corner of the floating body.

However, mooring lines simply control the position, in the horizontal direction, of the floating offshore structure to some extent, but not the position, in the vertical direction, of the floating offshore structure. Therefore, it may not be essential to equally apply tension at each corner of the floating body.

Therefore, in embodiments of the present embodiment, the position, in the horizontal direction, of the floating offshore structure can be controlled by spreading out mooring lines at two locations on one of the port and starboard sides of the floating offshore structure to apply tension.

This technical idea can allow spread mooring to FLNG vessels in areas of the sea with a benign marine environment, and a sufficient clearance can be secured between the second mooring lines 70 and the bottom surface of the LNG carrier 20, as illustrated in FIGS. 6 and 7.

When spread mooring is applied to an FLNG project, expensive turret equipment for freely rotating the hull and expensive thrust equipment for controlling the rotation of the hull whenever necessary are not needed, and as a result, the price of the FLNG project can be considerably lowered.

Figure 8:
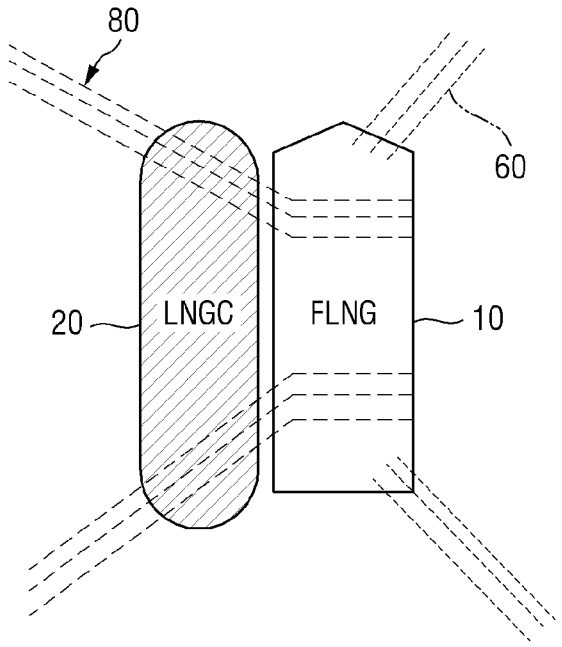
FIGS. 8 and 9 are a plan view and a cross-sectional view, respectively, of a floating offshore structure to which a one-side spread mooring system according to another embodiment of the present disclosure is applied.
Figure 9:
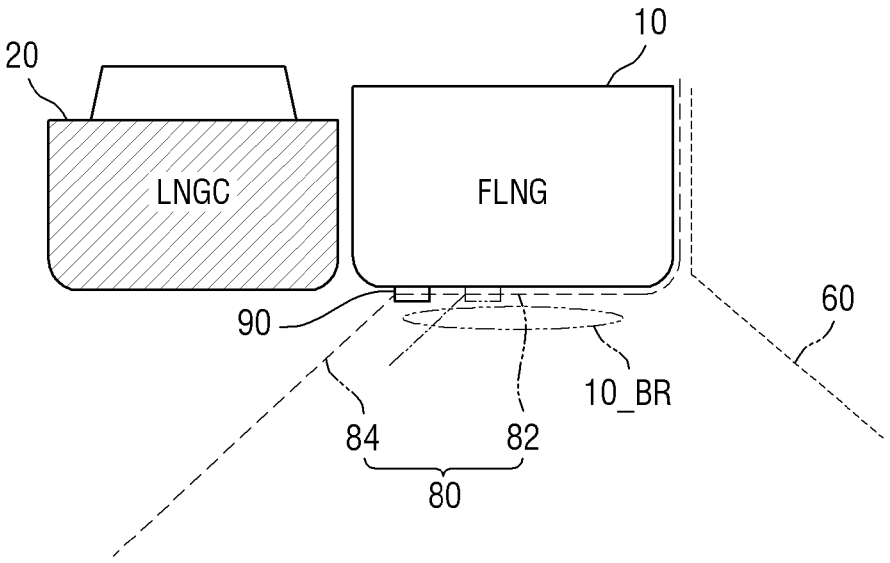

FIGS. 8 and 9 are a plan view and a cross-sectional view, respectively, of a floating offshore structure to which a one-side spread mooring system according to another embodiment of the present disclosure is applied.

The one-side spread mooring system of FIGS. 8 and 9 includes second mooring lines 80, instead of the second mooring lines 70 of the one-side spread mooring system of FIGS. 6 and 7. The second mooring lines 80 may be spread out into the seabed through a lower space 10_BR of the hull.

The second mooring lines 80 may include first sub-mooring lines 82, which extend horizontally from a first side (i.e., the starboard side in the example of FIGS. 8 and 9) where the one-side spread mooring system is applied to near a second side (i.e., the port side in the example of FIGS. 8 and 9) of an FLNG vessel 10, along the bottom surface of the FLNG vessel 10, and second sub-mooring lines 84, which are downwardly spread out from the first sub-mooring lines 82 toward the seabed. The first sub-mooring lines 82 include portions that are spread out in a vertical direction along one sidewall of the FLNG vessel 10 and portions that are spread out along the bottom surface of the FLNG vessel 10.

Points where the first sub-mooring lines 82 and the second sub-mooring lines 84 are connected may be determined such that the second sub-mooring lines 84 may have a sufficient clearance to avoid interference with the bottom surface of an LNG carrier 20.

A similar sense of balance to that provided by spreading out mooring lines on both sides of the FLNG vessel 10 as in the prior art can be provided by first mooring lines 60 and the second mooring lines 80 of FIGS. 8 and 9.

A line holding unit 90 may be installed on the bottom surface of the FLNG vessel 10.

The line holding unit 90 holds middle parts of the second mooring lines 80 so that the second mooring lines 80 are divided into the first sub-mooring lines 82, which are arranged horizontally along the bottom surface of the FLNG vessel 10, and the second sub-mooring lines 84, which are downwardly spread out.

The line holding unit 90 may be installed to be slidably movable in the direction of the line width of the FLNG vessel 10. For example, a rail structure or a linear bar structure may be applied between the line holding unit 90 and the bottom surface of the FLNG vessel 10.

The horizontal length of the first sub-mooring lines 82 and the points where the second sub-mooring lines 84 begin to be inclined downwardly may be determined by the position of the line holding unit 90, and the vertical distance from the bottom surface of the carrier 20 may be adjusted based on the position of the line holding unit 90. Accordingly, the sense of balance can be provided to the FLNG vessel 10 by slidably moving the line holding unit 90 in accordance with the circumstances such as the external environment, and the second mooring lines 80 can be spread out horizontally and at an inclination, while not interfering with the carrier 20 as much as possible.

A mooring winch may be installed between the FLNG vessel 10 and the mooring lines (i.e., the first mooring lines 60 and the second mooring lines 70 or 80). The mooring lines can be properly held by controlling the tension applied to the mooring lines through the control of the mooring winch to appropriately distribute the load.

The one-side spread mooring systems according to embodiments of the present disclosure have been described as being applied to FLNG vessels, but may also be applicable to various other offshore structures that require side-by-side offloading.

Figure 10:
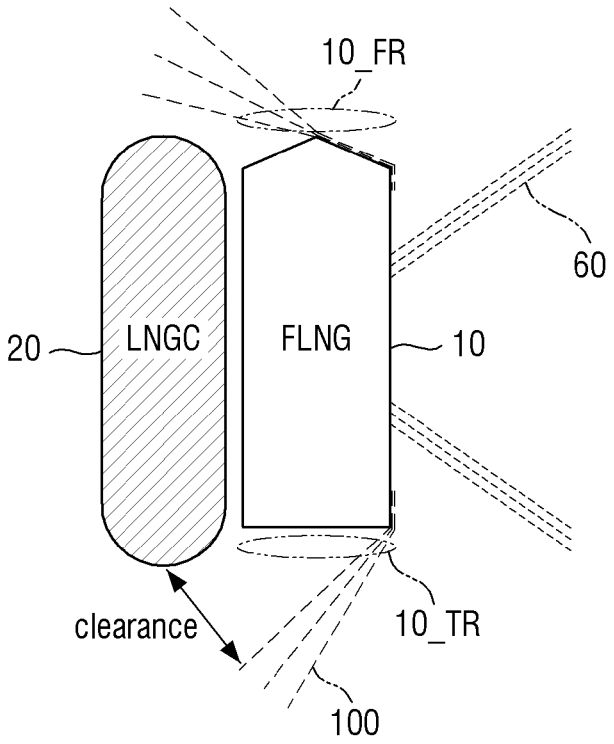
FIGS. 10 and 11 are a plan view and a cross-sectional view, respectively, of a floating offshore structure to which a one-side spread mooring system according to another embodiment of the present disclosure is applied.
Figure 11:
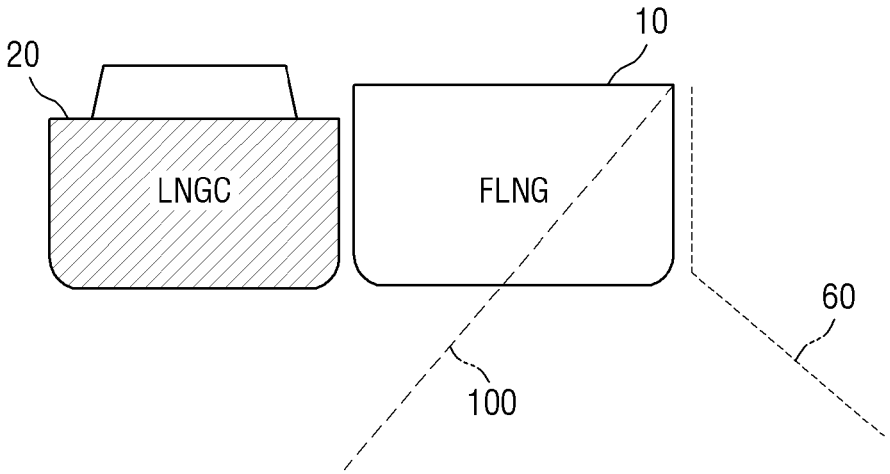

FIGS. 10 and 11 are a plan view and a cross-sectional view, respectively, of a floating offshore structure to which a one-side spread mooring system according to another embodiment of the present disclosure is applied. FIG. 11 may be a side view looking at the stern of an FLNG vessel 10. Although not specifically illustrated, a side view looking at the stern of the FLNG vessel 10 may be similar to that illustrated in FIG. 11.

First mooring lines 60 and second mooring lines 100 may be fastened to a first side of the FLNG vessel 10 (i.e., the starboard side in the example of FIGS. 10 and 11). The one-side spread mooring system of FIGS. 10 and 11 includes the second mooring lines 100, instead of the second mooring lines 70 of the one-side spread mooring system of FIGS. 6 and 7.

The second mooring lines 100 may be spread out into the seabed through a bow space 10_FR and a stern space 10_TR of the hull of the FLNG vessel 10. The second mooring lines 100 may be spread out toward from a first side to a second side of the FLNG vessel 10, passing through the centerline of the FLNG vessel 10. The second mooring lines 100 may be spread out in a second direction.

Here, the term "bow space" not only refers to the sidewall of the bow of the hull, but also encompasses the air and the sea ahead of (or above in the example of FIGS. 10 and 11) the bow of the hull.

Some of the second mooring lines 100 may be spread out along the outer wall of the hull of the FLNG vessel 10. FIG. 10 illustrates that some of the second mooring lines 100 include portions that are spread out along the sidewall on the first side of the FLNG vessel 10 (i.e., the sidewall of the starboard in the example of FIGS. 10 and 11), but the present disclosure is not limited thereto.

An LNG carrier 20 for the transport of cargo may perform side-by-side offloading by approaching the FLNG vessel 10, not from the first side where the first mooring lines 60 and the second mooring lines 100 are fastened, but from the second side (i.e., the port side in the example of FIGS. 10 and 11) of the FLNG vessel 10.

The second mooring lines 100 may be spread out from the bow of the FLNG vessel 10, which is connected to the first side of the FLNG vessel 10, into the seabed. In a plan view, a sufficient clearance can be secured between the LNG carrier 20 and the second mooring lines 70. As a result, interference between the LNG carrier 20 and the second mooring lines 70 can be avoided.

Figure 12:
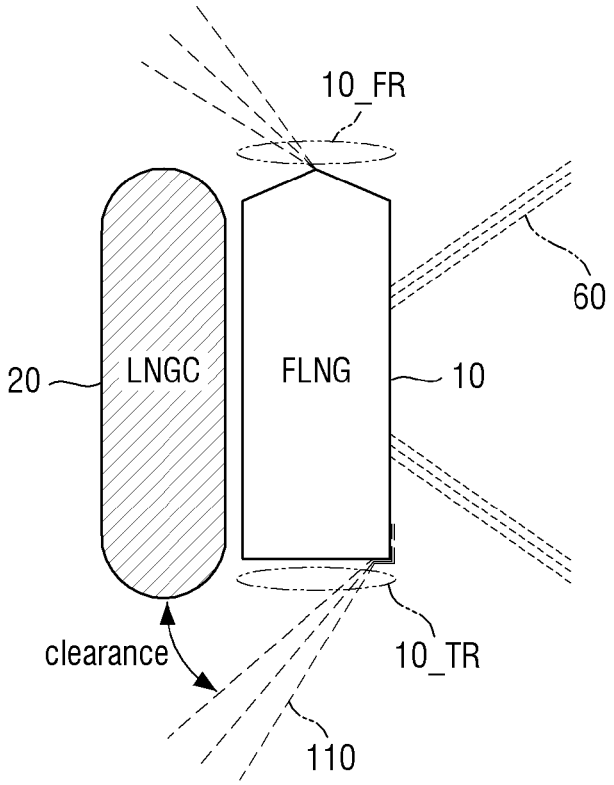
FIGS. 12 and 13 are a plan view and a cross-sectional view, respectively, of a floating offshore structure to which a one-side spread mooring system according to another embodiment of the present disclosure is applied.
Figure 13:
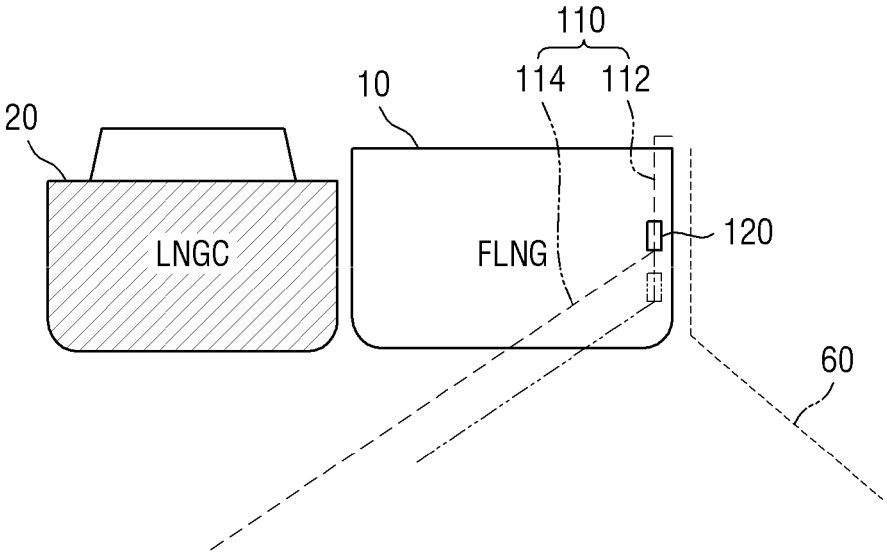

FIGS. 12 and 13 are a plan view and a cross-sectional view, respectively, of a floating offshore structure to which a one-side spread mooring system according to another embodiment of the present disclosure is applied. FIG. 12 may be a side view looking at the stern of an FLNG vessel 10. Although not specifically illustrated, a side view looking at the stern of the FLNG vessel 10 may be similar to that illustrated in FIG. 13.

First mooring lines 60 and second mooring lines 110 may be fastened to a first side (i.e., the starboard side in the example of FIGS. 12 and 13) of an FLNG vessel 10. The one-side spread mooring system of FIGS. 12 and 13 includes the second mooring lines 110, instead of the second mooring lines 100 of the one-side spread mooring system of FIGS. 10 and 11.

The second mooring lines 110 may be spread out into the seabed through a bow space 10_FR and a stern space 10_TR of the hull of the FLNG vessel 10.

The second mooring lines 110 may include first sub-mooring lines 112 and second sub-mooring lines 114. The first sub-mooring lines 112 may extend in a vertical direction along the sidewall at the stern of the FLNG vessel 10. The second sub-mooring lines 114 may be parts of the second mooring lines 110 that are spread out at an inclination from the first sub-mooring lines 112 toward the seabed.

In a plan view, points where the first sub-mooring lines 112 and the second sub-mooring lines 114 are connected may be determined such that the second sub-mooring lines 114 have a sufficient clearance to avoid interference with an LNG carrier 20.

Although not specifically illustrated, the second mooring lines 110 may include first sub-mooring lines 112 extending extend vertically along the sidewall at the stern of the FLNG vessel 10 and second sub-mooring lines 114 spread out at a downward inclination toward the seabed.

A line holding unit 120 may be installed on the sidewall at the stern of the FLNG vessel 10. The line holding unit 120 holds middle parts of the second mooring lines 110 so that the second mooring lines 110 are divided into first sub-mooring lines 82 and second sub-mooring lines 84.

The line holding unit 120 may be installed to be slidably movable in the direction of the height of the FLNG vessel 10. For example, a rail structure or a linear bar structure may be applied between the line holding unit 120 and the sidewall at the stern of the FLNG vessel 10.

The horizontal length of the first sub-mooring lines 112 and the points where the second sub-mooring lines 114 begin to be inclined downwardly may be determined by the position of the line holding unit 120. That is, the line holding unit 120 may determine points where the second mooring lines 110 begin to be apart from the stern of the FLNG vessel 10. Also, the clearance between the second mooring lines 110 and the carrier 20 may be adjusted based on the position of the line holding unit 120.

Accordingly, the sense of balance can be provided to the FLNG vessel 10 by slidably moving the line holding unit 120 in accordance with the circumstances such as the external environment, and the second mooring lines 110 can be spread out vertically and at an inclination, while not interfering with the carrier 20 as much as possible.

Although not specifically illustrated, the line holding unit 120 may be installed on the sidewall at the bow of the FLNG vessel 10. Second mooring lines 110 spread out in a second direction through a bow space 100_FR of the FLNG vessel 10 are substantially as already described above.

Although the above has been described with reference to the embodiments of the present invention, it will be understood that those skilled in the art can modify the present invention in various manners without departing from the spirit and scope of the present invention described in the claims below.

It is claimed is:

1. A floating offshore structure to which a one-side spread mooring system is applied, comprising:

first mooring lines fastened to one of a port and a starboard of a hull, the first mooring lines being spread out in a first direction, which is a direction away from the hull, into a seabed; and second mooring lines fastened to the same side of the hull as the first mooring lines, the second mooring lines being spread out in a second direction, which is a direction toward an opposite side of a centerline of the hull to the first mooring lines, into the seabed through a lower space of the hull.

2. The floating offshore structure of claim 1, wherein the second mooring lines are spread out in a horizontal direction along a bottom surface of the hull and then spread out at a downward inclination into the seabed.

3. The floating offshore structure of claim 1, further comprising:

a line holding unit holding middle parts of the second mooring lines, the line holding unit being installed on a bottom surface of the hull to be slidably movable.

4. The floating offshore structure of claim 3, wherein points where the second mooring lines begin to be spread out at the downward inclination into the seabed are determined by a position of the line holding unit.

5. The floating offshore structure of claim 1, wherein the floating offshore structure is a Floating Liquefied Natural Gas (FLNG) vessel.

6. The floating offshore structure of claim 1, wherein side-by-side offloading is performed by a carrier approaching the floating offshore structure, from a side of the floating offshore structure where the first mooring lines and the second mooring lines are not connected.

7. A floating offshore structure to which a one-side spread mooring system is applied, comprising:

first mooring lines fastened to one of a port and a starboard of a hull, the first mooring lines being spread out in a first direction, which is a direction away from the hull, into a seabed; and second mooring lines fastened to the same side of the hull as the first mooring lines, the second mooring lines being spread out in a second direction, which is a direction toward an opposite side of a centerline of the hull to the first mooring lines, into the seabed.

8. The floating offshore structure of claim 7, wherein some of the second mooring lines are spread out along an outer wall of the hull, or the second mooring lines are spread out in the second direction through a lower space of the hull.

9. The floating offshore structure of claim 8, wherein the second mooring lines include first sub-mooring lines, which extend in a horizontal direction along a bottom surface of the hull, and second sub-mooring lines, which are connected to the first sub-mooring lines and are spread out at a downward inclination into the seabed.

10. The floating offshore structure of claim 8, further comprising:

a line holding unit holding middle parts of the second mooring lines, the line holding unit being installed on a bottom surface of the hull to be slidably movable, wherein points where the second mooring lines begin to be spread out at the downward inclination into the seabed are determined by a position of the line holding unit.

11. The floating offshore structure of claim 7, wherein the second mooring lines are spread out in the second direction through bow and stern spaces of the hull.

12. The floating offshore structure of claim 11, wherein the second mooring lines include first sub-mooring lines, which extend in a vertical direction along sidewalls at a bow and a stern of the hull, and second sub-mooring lines, which are connected to the first sub-mooring lines and are spread out at a downward inclination into the seabed.

13. The floating offshore structure of claim 11, further comprising:

a line holding unit holding middle parts of the second mooring lines, the line holding unit being installed on a bottom surface of the hull to be slidably movable.

14. The floating offshore structure of claim 13, wherein points where the second mooring lines begin to be apart from a bow and a stern of the hull are determined by a position of the line holding unit.

15. The floating offshore structure of claim 7, wherein side-by-side offloading is performed by a carrier approaching the floating offshore structure, from a side of the floating offshore structure where the first mooring lines and the second mooring lines are not connected.

16. A floating offshore structure to which a one-side spread mooring system is applied, comprising:

first mooring lines fastened to one of a port and a starboard of a hull, the first mooring lines being spread out in a first direction, which is a direction away from the hull, into a seabed; and second mooring lines configured to be spread out into the seabed in a second direction through a bow space and a stern space of the hull, the second mooring lines fastened to the same side of the hull as the first mooring lines, the second mooring lines being spread out in a direction toward an opposite side of the centerline of the hull to the first mooring lines.

* * * * *